US011882896B2

(12) United States Patent
Koo

(10) Patent No.: US 11,882,896 B2
(45) **Date of Patent: *Jan. 30, 2024**

(54) SHOE BOTTOM SURFACE HAVING ATTACHED PARTICLES

(71) Applicant: Dynasty Footwear, Ltd., El Segundo, CA (US)

(72) Inventor: John C. S. Koo, Los Angeles, CA (US)

(73) Assignee: DYNASTY FOOTWEAR, LTD., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/557,361

(22) Filed: Dec. 21, 2021

(65) Prior Publication Data

US 2022/0110409 A1 Apr. 14, 2022

Related U.S. Application Data

(63) Continuation of application No. 16/172,734, filed on Oct. 27, 2018, now Pat. No. 11,234,487, which is a continuation of application No. 14/562,614, filed on Dec. 5, 2014, now Pat. No. 10,143,267.

(60) Provisional application No. 61/922,569, filed on Dec. 31, 2013.

(51) Int. Cl.

| | |
|---|---|
| ***A43B 23/28*** | (2006.01) |
| ***A43B 13/22*** | (2006.01) |
| ***A43B 13/26*** | (2006.01) |

(52) U.S. Cl.

CPC ..... *A43B 13/22* (2013.01); *A43B 13/26* (2013.01)

(58) Field of Classification Search

CPC ..... A43D 63/00; A43B 13/22; A43B 13/26

USPC ..... 36/59 R; 428/396, 323, 326, 402, 473

See application file for complete search history.

(56) References Cited

U.S. PATENT DOCUMENTS

| | | | |
|---|---|---|---|
| 123,450 | A | 2/1872 | Bryant |
| 140,241 | A | 6/1873 | Bryant |
| 384,483 | A | 6/1888 | Walters |
| 1,395,958 | A | 11/1921 | Hamilton |
| 1,499,785 | A | 7/1924 | Regula |
| 1,716,790 | A | 6/1929 | Mitchell |
| 1,782,382 | A | 11/1930 | Eggers et al. |
| 1,811,803 | A | 6/1931 | Oakley |

(Continued)

FOREIGN PATENT DOCUMENTS

| | | |
|---|---|---|
| CN | 98234514 | 12/1999 |
| EP | 0516874 A1 | 12/1992 |

(Continued)

OTHER PUBLICATIONS

"Extrusion", definition from Wikipedia, printed out from http://en.wikipedia.org/wiki/Extrusion on May 16, 2007.

(Continued)

*Primary Examiner* — Katharine G Kane

(74) *Attorney, Agent, or Firm* — LOZA & LOZA, LLP; Joseph G. Swan

(57) ABSTRACT

Provided is a shoe that includes a sole that: (i) has a bottom surface that is adjacent to the ground in normal use, and (ii) is comprised of both a base material forming a main structure and individual leather particles attached to the base material on the bottom surface of the sole. The individual leather particles may have a median size within a range of 0.3 to 4.0 millimeters (mm). In addition, or instead, individual second particles made of a material other than leather also are attached to the base material on the bottom surface of the sole.

16 Claims, 2 Drawing Sheets

(56) References Cited

U.S. PATENT DOCUMENTS

| | | | |
|---|---|---|---|
| 1,978,030 | A | 10/1934 | Ritchie |
| 1,989,467 | A | 1/1935 | Francis |
| 2,075,229 | A | 3/1937 | Rose |
| 2,121,678 | A | 6/1938 | Armor |
| 2,250,987 | A | 7/1941 | Dunbar |
| 2,287,282 | A | 6/1942 | Tousley |
| 2,371,689 | A | 11/1942 | Gregg et al. |
| 2,333,303 | A | 11/1943 | Enos |
| 2,362,378 | A | 11/1944 | Holbrook et al. |
| 2,393,433 | A | 1/1946 | V'Soske |
| 2,393,434 | A | 1/1946 | V'Soske |
| 2,400,487 | A | 5/1946 | Clark |
| 2,426,524 | A | 8/1947 | Rosenbarger |
| 2,427,882 | A | 9/1947 | Schulte |
| 2,550,354 | A | 4/1951 | Jacobsen |
| 2,570,949 | A | 10/1951 | Hoffenberg |
| 2,640,283 | A | 6/1953 | McCord |
| 2,663,097 | A | 12/1953 | Giese |
| 2,732,065 | A | 1/1956 | Marchese |
| 2,736,926 | A | 3/1956 | Johnson |
| 2,793,136 | A | 5/1957 | Root |
| 2,850,214 | A | 9/1958 | Rooney, Jr. |
| 3,007,205 | A | 11/1961 | House |
| 3,027,661 | A | 4/1962 | McCord |
| 3,303,250 | A | 2/1967 | Bingham, Jr. |
| 3,543,420 | A | 12/1970 | Dassler |
| 3,555,697 | A | 1/1971 | Dassler |
| 3,629,051 | A | 12/1971 | Mitchell |
| 3,698,357 | A | 10/1972 | Spencer |
| 3,776,753 | A | 12/1973 | Habib |
| 3,798,048 | A | 3/1974 | Brody et al. |
| 3,824,715 | A | 7/1974 | Vaughan et al. |
| 3,888,026 | A | 6/1975 | Dassler |
| 3,918,181 | A | 11/1975 | Inohara |
| 4,007,549 | A | 2/1977 | Moore |
| 4,021,860 | A | 5/1977 | Swallow et al. |
| 4,055,699 | A | 10/1977 | Hsiung |
| 4,089,069 | A | 5/1978 | Vistins |
| 4,108,452 | A | 8/1978 | Baron |
| 4,151,662 | A | 5/1979 | Vistins |
| 4,160,331 | A | 7/1979 | Bell |
| 4,172,293 | A | 10/1979 | Vistins |
| 4,217,704 | A | 8/1980 | Whitaker |
| 4,250,306 | A | 2/1981 | Lask et al. |
| 4,291,428 | A | 9/1981 | Anzani |
| 4,345,702 | A | 8/1982 | Wolfe |
| 4,356,643 | A | 11/1982 | Kester et al. |
| 4,374,460 | A | 2/1983 | Towsend |
| 4,405,730 | A | 9/1983 | Cohen |
| 4,489,510 | A | 12/1984 | Williams |
| 4,497,871 | A | 2/1985 | Henke |
| 4,501,077 | A | 2/1985 | Young |
| 4,519,148 | A | 5/1985 | Sisco |
| 4,535,121 | A | 8/1985 | Oezelli et al. |
| 4,554,749 | A | 11/1985 | Ostrander |
| 4,640,858 | A | 2/1987 | Barnett |
| 4,658,514 | A | 4/1987 | Shin |
| 4,702,021 | A | 10/1987 | Cameron |
| 4,779,360 | A | 10/1988 | Bible |
| 4,825,564 | A | 5/1989 | Sorce |
| RE33,018 | E | 8/1989 | Ostrander |
| 4,879,969 | A | 11/1989 | Haranoya et al. |
| 4,899,411 | A | 2/1990 | Johnson et al. |
| 4,924,608 | A | 5/1990 | Mogonye |
| 4,963,392 | A | 10/1990 | Molnar et al. |
| 4,963,422 | A | 10/1990 | Katz et al. |
| 5,038,500 | A | 8/1991 | Nicholson |
| 5,108,777 | A | 4/1992 | Laird |
| 5,173,325 | A | 12/1992 | Knobbe et al. |
| 5,259,125 | A | 11/1993 | Gromes |
| 5,263,233 | A | 11/1993 | Kim et al. |
| 5,276,981 | A | 1/1994 | Schaffer et al. |
| 5,290,607 | A | 3/1994 | Chitouras |
| 5,403,638 | A | 4/1995 | Yanagizawa et al. |
| 5,403,884 | A | 4/1995 | Perlinski |
| 5,425,186 | A | 6/1995 | Hoyt |
| 5,485,687 | A | 1/1996 | Rohde |
| 5,694,704 | A | 12/1997 | Kasbrick |
| 5,799,418 | A | 9/1998 | Davis |
| 5,921,005 | A | 7/1999 | Bell et al. |
| 5,928,731 | A | 7/1999 | Yanagida et al. |
| 6,055,748 | A | 5/2000 | Harrison |
| 6,106,920 | A | 8/2000 | Pichon et al. |
| 6,182,377 | B1 | 2/2001 | Toensing |
| 6,214,141 | B1 | 4/2001 | Kim et al. |
| 6,243,973 | B1 | 6/2001 | Lind |
| 6,255,235 | B1 | 7/2001 | Hiraoka et al. |
| 6,306,498 | B1 | 10/2001 | Yuuki et al. |
| 6,430,844 | B1 | 8/2002 | Otis |
| 6,660,205 | B1 | 12/2003 | Harkins, Sr. |
| 6,900,547 | B2 | 5/2005 | Polk, Jr. et al. |
| 6,913,784 | B2 | 7/2005 | Xue et al. |
| 7,191,549 | B2 | 3/2007 | Koo |
| 7,516,506 | B2 | 4/2009 | Koo et al. |
| 7,827,640 | B2 | 11/2010 | Koo et al. |
| 8,156,663 | B2 | 4/2012 | Shelton et al. |
| 2002/0035796 | A1 | 3/2002 | Knoche et al. |
| 2002/0112379 | A1 | 8/2002 | Sussmann et al. |
| 2002/0157281 | A1 | 10/2002 | Safdeye et al. |
| 2003/0009919 | A1 | 1/2003 | Stein |
| 2003/0121179 | A1 | 7/2003 | Chen |
| 2003/0171049 | A1 | 9/2003 | Arnold et al. |
| 2003/0175417 | A1 | 9/2003 | Trevisan |
| 2004/0091784 | A1 | 5/2004 | Frederiksson et al. |
| 2004/0163190 | A1 | 8/2004 | Loughran |
| 2004/0194341 | A1 | 10/2004 | Koo |
| 2004/0194345 | A1 | 10/2004 | Koo |
| 2008/0230942 | A1 | 9/2008 | Koo |

FOREIGN PATENT DOCUMENTS

| | | |
|---|---|---|
| GB | 0886222 | 1/1962 |
| GB | 1289782 | 9/1972 |
| GB | 1443331 | 7/1976 |
| GB | 2 201 082 | 8/1988 |
| JP | S59-362 | 1/1984 |
| JP | S61-225380 | 10/1986 |
| JP | 62071695 | 4/1987 |
| JP | H3-170101 | 7/1991 |
| JP | 2000308501 | 11/2007 |
| WO | WO2001/26863 | 4/2001 |
| WO | WO2004042847 | 5/2004 |

OTHER PUBLICATIONS

"Plastics extrusion", definition from Wikipedia, printed out from http://en.wikipedia.org/wiki/Plastics_extrusion on May 16, 2007.

International Search Report and Written Opinion of the International Searching Authority in PCT application PCT/US07/69410, dated Aug. 14, 2008.

Prosecution history of, including prior art cited in, U.S. Appl. No. 11/751,581 (now U.S. Pat. No. 7,516,506).

Prosecution history of, including prior art cited in, U.S. Appl. No. 12/408,702 (now U.S. Pat. No. 7,827,640).

Prosecution history of, including prior art cited in, U.S. Appl. No. 12/898,550 (now U.S. Pat. No. 8,234,736).

Prosecution history of, including prior art cited in, U.S. Appl. No. 13/543,858.

Prosecution history of, including prior art cited in, U.S. Appl. No. 10/438,375 (now U.S. Pat. No. 7,191,549).

Prosecution history of, including prior art cited in, U.S. Appl. No. 11/674,668.

Prosecution history of, including prior art cited in, U.S. Appl. No. 12/912,722 (now U.S. Pat. No. 8,647,460).

Prosecution history of, including prior art cited in, U.S. Appl. No. 12/912,729 (now U.S. Pat. No. 3,808,487).

Prosecution history of, including prior art cited in, U.S. Appl. No. 11/530,419 (now U.S. Pat. No. 8,661,713).

Prosecution history of, including prior art cited in, U.S. Appl. No. 11/866,289 (now U.S. Pat. No. 7,846,493).

(56) References Cited

OTHER PUBLICATIONS

Prosecution history of, including prior art cited in, U.S. Appl. No. 14/093,706 (now U.S. Pat. No. 9,894,955).
Prosecution history of, including prior art cited in, U.S. Appl. No. 14/274,929.
Prosecution history of, including prior art cited in, parent U.S. Appl. No. 14/562,614 (now U.S. Pat. No. 10,143,267).
Prosecution history of, including prior art cited in, parent U.S. Appl. No. 16/172,734.

SHOE BOTTOM SURFACE HAVING ATTACHED PARTICLES

The present application is a continuation of U.S. Patent Application Ser. No. 16/172,735, filed Oct. 27, 2018, which is a continuation of U.S. Patent Application Ser. No. 14/562,614, filed Dec. 5, 2014 (now U.S.) Patent 10,143,267), which claims priority to U.S. Provisional Patent Application Ser. No. 61/922,569, filed Dec. 31, 2013. In addition, this application builds on the disclosures set forth in U.S. patent application Ser. No. 10/438,375, filed May 15, 2003 (now U.S. Pat. No. 7,191,549); Ser. No. 11/751,581, filed May 21, 2007 (now U.S. Pat. No. 7,516,506); Ser. No. 10/613,741, filed Jul. 3, 2003; Ser. No. 11/530,419, filed Sep. 8, 2006 (now U.S. Pat. No. 8,661,713); and Ser. No. 11/866,289, filed Oct. 2, 2007 (now U.S. Pat. No. 7,846,493). All of the foregoing applications (referred to herein as the "Related Applications") are incorporated by reference herein as though set forth herein in full.

FIELD OF THE INVENTION

The present invention pertains, among other things, to systems, methods and techniques for providing particles on the bottom surface of footwear, as well as to footwear having particles on their bottom surfaces.

BACKGROUND

The Related Applications, among other things, disclose various techniques for applying individual particles to the bottom of a shoe and disclose particular types of particles to be used for these purposes. However, the present inventor has now discovered various improvements, e.g., in the particles used for these purposes.

SUMMARY OF THE INVENTION

In addition to further improvements in the specific particles used, the present inventor has discovered that it often is beneficial to apply certain combinations of different kinds of particles to the bottom of a shoe, rather than using just a single type.

One embodiment of the invention is directed to a shoe that includes: (a) a sole that: (i) has a bottom surface that is adjacent to the ground in normal use, and (ii) is comprised of both a base material forming a main structure and a plurality of individual leather particles attached to the base material on the bottom surface of the sole; and (b) an upper portion extending above the sole. According to this embodiment, the individual leather particles have a median size within a range of 0.3 to 4.0 millimeters (mm), and the size of a particle is defined as a maximum dimension of the particle.

Using leather particles within this size range often can provide better results for a hybrid shoe sole than prior-art techniques which use smaller particles. In addition, particles of these sizes often can be produced less expensively than the powder-sized particles which have been used in the prior art.

Another embodiment is directed to a shoe that includes: (a) a sole that: (i) has a bottom surface that is adjacent to the ground in normal use, and (ii) is comprised of a base material forming a main structure together with a plurality of individual first particles made of leather and a plurality of individual second particles made of a material other than leather, with the individual first and second particles attached to the base material on the bottom surface of the sole; and (b) an upper portion extending above the sole.

By using combinations of particles in this manner, it is often possible to tailor the properties of the bottom surface of the shoe or other item of footwear for a particular purpose and/or for use within a particular environment.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the attached drawings. However, it should be understood that the drawings merely depict certain representative and/or exemplary embodiments and features of the present invention and are not intended to limit the scope of the invention in any manner. The following is a brief description of each of the attached drawings.

DESCRIPTION OF THE PREFERRED EMBODIMENT(S)

Figure 1:
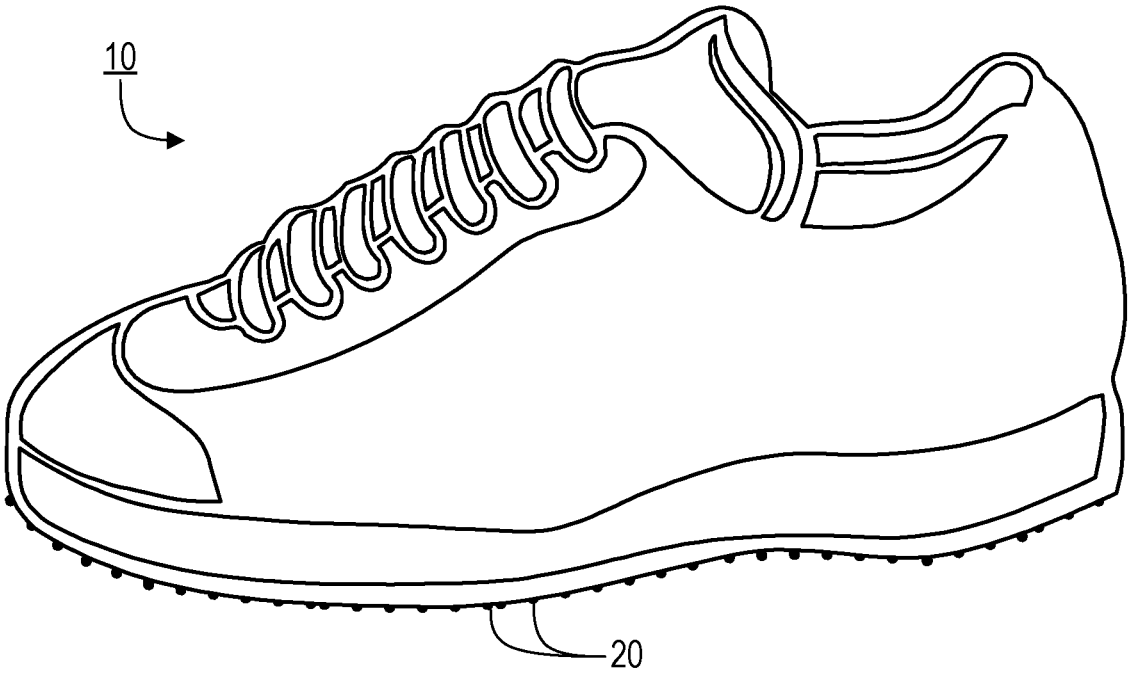
FIG. 1 is a perspective view of a representative shoe having particles attached to its bottom surface according to the present invention.
Figure 2:
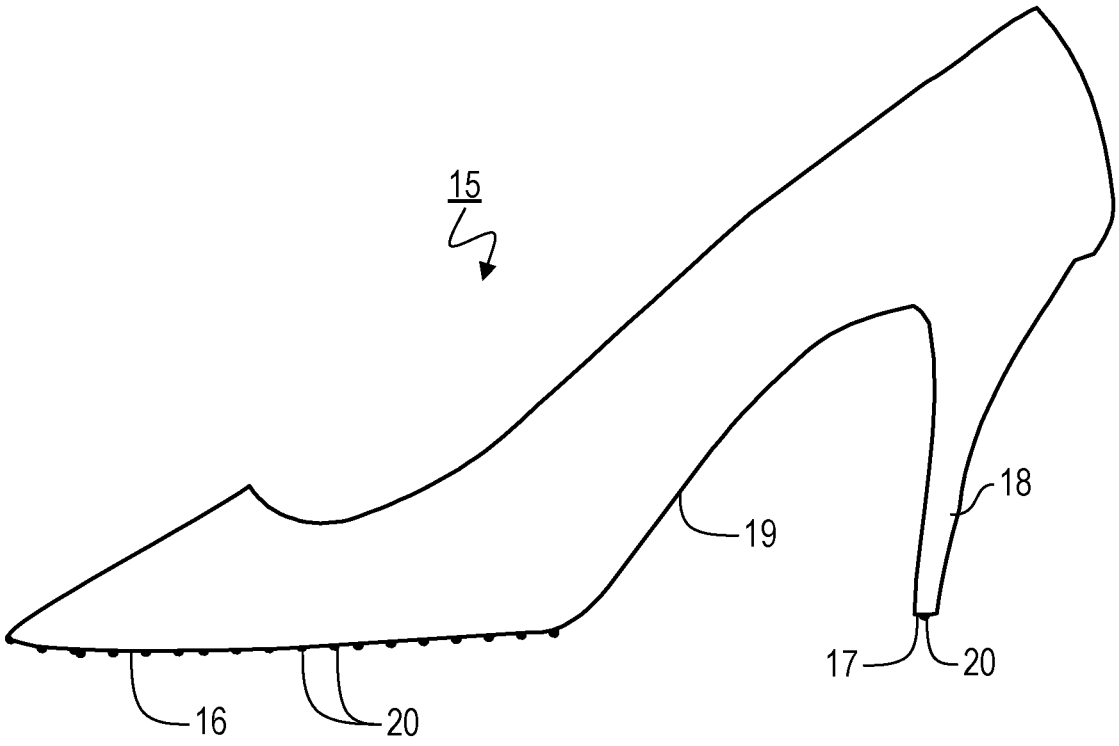
FIG. 2 is a side elevational view of a shoe having particles attached to portions of its bottom surface in accordance with the present invention.

In certain embodiments of the present invention, particles are bonded to, embedded within or otherwise attached to the base material that provides the main structure for the bottom surface of a shoe or other item of footwear. Exemplary shoes 10 and 15 having such attached particles 20 are shown in FIGS. 1 and 2, respectively. For illustrative clarity, such particles 20 are shown in FIGS. 1 and 2 enlarged and spatially separated more than normally would be the case. In these embodiments, the particles 20 are attached only to the portions of the bottom surface of the shoe (10 or 15) that comes into contact with the ground in normal use (e.g., when a wearer is walking or running on a substantially flat and smooth ground surface). Thus, for example, athletic shoe 10 has a substantially flat bottom surface and, therefore, the particles 20 are attached to its entire bottom surface (potentially excluding any indented portions that ordinarily would not come into contact with the ground's surface). For high-heeled shoe 15, shown in FIG. 2, the front portion 16 of its sole and the bottom 17 of its heel 18 normally would come into contact with the ground during normal use, so the particles 20 are attached to those portions of the bottom surface of shoe 15. However, the portion 19 of the shoe's sole in between such portions 16 and 17 is elevated and, therefore, ordinarily would not come into contact with the ground in normal use (e.g., when worn and used for walking or running), so particles 20 are not attached to portion 19. It is noted that the bottom surface of a shoe typically will include the bottom of the shoe's sole and, if a separate heel is provided, also will include the bottom surface of the heel.

Rather than attaching particles 20 just to the portion of the bottom surface that ordinarily comes into contact with the ground in normal use, in alternate embodiments particles 20 are attached to the entire bottom surface or to other portions of it that do not ordinarily come into contact with the ground. Although particles 20 typically will only be functional to the extent they contact the ground, they may also be attached to other areas for other purposes, such as for providing a decorative design or for supplementing a design formed by the functional particles 20. In any event, for import duty purposes and/or to achieve other desired effects (e.g., in terms of increased traction, slip-resistance and/or increased composition of natural or organic materials, it often will be preferable to attach particles 20 to at least 50% of the portion of the bottom surface that contacts the ground during normal use.

The particles 20 can include just a single type of particle (e.g., of a single kind of shape or configuration and/or made of a single kind of material) or else (e.g., in certain preferred embodiments) can include different kinds of particles (e.g., made of different materials). The primary shape or configuration characteristics that can be selected typically include: (1) elongated (e.g., fibers) or compact (e.g., spheres or cubes), (2) whether the particles have a significant number of sharp edges (e.g., randomly oriented rectangular prisms) or substantially smooth surfaces (e.g., spheres or ellipsoids) that contact the ground, and (3) whether the particles have sharp points that contact the ground (e.g., fibers oriented at substantially perpendicularly to the shoe's bottom surface. As indicated in the preceding sentence, a particle's configuration can be specified in part based on its orientation relative to the shoe's bottom surface, e.g., so that a fiber will present a substantially smooth surface if oriented parallel to the shoe's bottom surface, but typically will present a sharp point if oriented perpendicularly, and will present a directional characteristic (smooth surface when the bottom surface is slid in one direction and a sharp point when the bottom surface is slid in the opposite direction) when oriented at a 30° angle relative to the shoe's bottom surface. In the preferred embodiments, these characteristics are selected to achieve one or more desired functional characteristics (from the choices noted above) for any given article of footwear.

In the embodiments in which combinations of different kinds of particles are used, generally speaking, the preferred combinations include leather particles in addition to one or more other types of natural and/or organic particles. In particular preferred embodiments, all of such particles have been subjected at most to only limited processing, so they are as close as possible to their naturally occurring states. In certain embodiments, the leather particles have been formed by grinding sheets of leather into substantial pieces (e.g., having a median or average size within a range of approximately 0.3 millimeter (mm) to 4.0 mm (more preferably, 0.4-3.0 mm or, even more preferably, 0.5-2.0 mm), or by separating the leather into individual fibers. In any event, the particles preferably have a median or average size of at least 0.3, 0.5, 1.0, 2.0 or 4.0 mm. In the preceding discussion, depending upon the embodiment, size of a particle is intended to mean the particle's length (maximum dimension) or its characteristic dimension (e.g., its average linear measurement over three orthogonal dimensions, or the cube root of the volume occupied by the particle's outer extent). In any case, it generally is preferable that the resulting particles should be small enough to be suitable for being propelled using a flocking or similar technique, but still have significant mass (e.g., larger than powder-sized particles) to have a significant macro impact on the properties of the shoe's bottom surface and/or for wear-resistance over long-term use. Also, at least 100, 500 or 1,000 particles of a single type, or of each of at least two different types, preferably are used and, more preferably, have the sizes noted above.

It should be noted that whenever "leather" is referred to herein, unless further qualified, such references are intended to mean any type of natural animal hide, having been subjected to any kind and/or amount of processing—from the raw, naturally occurring hide to fully finished leather or similar finished animal skin. Typically, any such processing will be performed while the animal skin doing is in sheet form, i.e., prior to separating it into individual particles.

In certain embodiments, the leather particles constitute at least 50% (e.g., by weight or by volume) of the particle mixture used according to the present invention. In addition, after application to the bottom of the shoe, the particle mixture (e.g., including leather and other kinds of natural particles) preferably covers at least 50% of the bottom surface of the shoe that contacts the ground in ordinary use.

The other particles that make up the mixture preferably include natural plant material that has been dried and/or ground or chopped into small fibers or other particles. As used herein, a material in its "naturally occurring state is" intended to mean how the material occurs in nature, with only minimal, non-transformative processing such as drying, cutting or grinding. Although in certain embodiments the foregoing natural plant particles are (or include) cotton or similar materials, in the preferred embodiments such particles originate from parts of the plant other than the flower, fruit, boll or other type of seed pod. Such other parts (which typically are much less expensive and have significantly thicker and stronger fibers) can include, e.g., the stalks, stems, needles, fronds, husks and/or even the leaves of a plant (although leaves typically do not have the strong, thick fibers that are preferred). More specific examples of such materials include cornhusk, hemp, straw or the like. In various embodiments of the present invention, one or more of such plant material particles are included in the mixture, e.g., depending upon the more specific properties that are desired in the final product.

Figure 3:
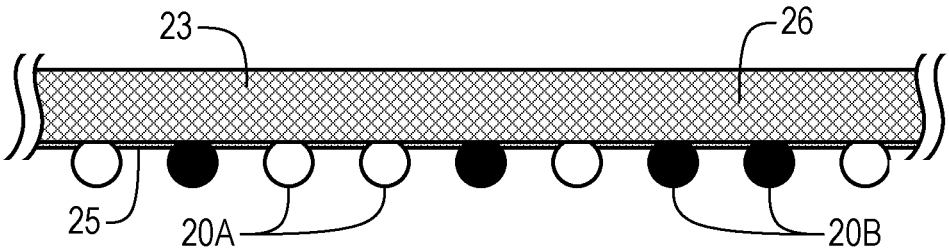
FIG. 3 is a side elevational view of a portion of a shoe bottom having two different types of particles attached using a separate adhesive material.

A particle mixture according to the present invention can be applied to the bottom surface of a shoe (or other item of footwear) in any of a variety of different ways, such as in any of the ways described in the Related Applications. Thus, for example, as shown in FIG. 3, the particles 20A and 20B (representing two different types of particles 20, made of two different materials) can be mixed together and then applied by flocking, spraying or dropping them onto the base material 23 forming the structure of the bottom surface of a shoe, after such base material 23 that has been partially or entirely coated with a separate adhesive material 25. As a result, the overall base material 26 (including original base material 23 and a coating of adhesive material 25), together with the combination of particles 20A and 20B form the bottom surface of that portion of the shoe to which such particles 20A and 20B have been attached.

Figure 4:
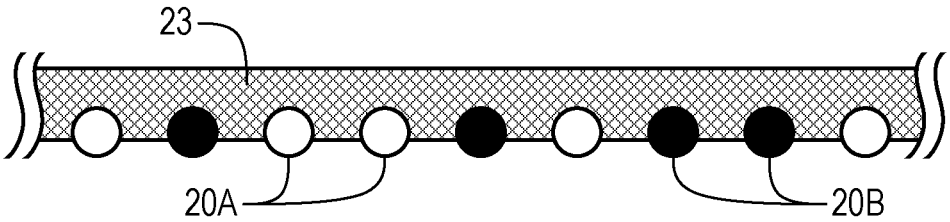
FIG. 4 is a side elevational view of a portion of a shoe bottom having two different types of particles molded into the shoe bottom's base material.

In alternate embodiments, the mixture of particles 20A and 20B has been molded into the shoe bottom, e.g., (1) by placing the particles 20A and 20B into a mold and then injecting in the base material 23 on top of such particles 20A and 20B, with the result shown in FIG. 4; (2) by mixing particles 20A and 20B with the base material and injecting the resulting composite material into a mold for forming a bottom layer of the shoe; (3) by first gluing or otherwise attaching particles 20A and 20B to a substrate and then molding in the substrate with attached particles 20A and 20B; and/or (4) by pressing particles 20A and 20B into the surface of a base material 23 that has already been formed as the shoe's outsole (or the bottom layer thereof) or that will be subsequently formed for that purpose, e.g., using heat and/or pressure.

Any of the particles mentioned herein and/or in the Related Applications can be applied separately or in combination with one or more other kinds of particles. Where a combination of particles is used, a combination of leather and plant material generally is preferred, e.g., due to their synergistic effects (e.g., with respect to slip-resistance on different types of walking surfaces). However, other embodiments of the present invention use mixtures of other kinds of particles. For instance, particles 20 might include just different kinds of plant particles alone (e.g., any of the kinds of plant particles mentioned above).

Still further, in certain embodiments, the particles 20 preferably are attached just to a relatively thin layer of the shoe's bottom surface (e.g., no deeper than the bottom 1-10 mm). However, in alternate embodiments the particles 20 extend deeper (e.g., to all or substantially all of the usable depth of the shoe's sole, e.g., that portion which can be worn down while still allowing the shoe to be considered acceptable by an ordinary middle-class consumer).

Additional Considerations.

In the event of any conflict or inconsistency between the disclosure explicitly set forth herein or in the attached drawings, on the one hand, and any materials incorporated by reference herein, on the other, the present disclosure shall take precedence. In the event of any conflict or inconsistency between the disclosures of any applications or patents incorporated by reference herein, the more recently filed disclosure shall take precedence.

Words such as "optimal", "optimize", "minimize", "maximize", "best" and similar words are used throughout the above discussion. However, it should be understood that, except to the extent clearly indicated to the contrary, such words are not used in their absolute sense, but rather are intended to be viewed in light of other constraints, such as user-specified constraints and objectives, as well as cost and processing constraints.

In the above discussion, certain methods are explained by breaking them down into steps listed in a particular order. However, it should be noted that in each such case, except to the extent clearly indicated to the contrary or mandated by practical considerations (such as where the results from one step are necessary to perform another), the indicated order is not critical but, instead, that the described steps can be reordered and/or two or more of such steps can be performed concurrently.

References herein to a "criterion", "multiple criteria", "condition", "conditions" or similar words which are intended to trigger, limit, filter or otherwise affect processing steps, other actions, the subjects of processing steps or actions, or any other activity or data, are intended to mean "one or more", irrespective of whether the singular or the plural form has been used. For instance, any criterion or condition can include any combination (e.g., Boolean combination) of actions, events and/or occurrences (i.e., a multi-part criterion or condition).

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

In the discussions above, the words "include", "includes", "including", and all other forms of the word should not be understood as limiting, but rather any specific items following such words should be understood as being merely exemplary.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention are to be considered as within the scope thereof as limited solely by the claims appended hereto.

What is claimed is:

1. A shoe comprising:

(a) a sole that: (i) has a bottom surface that is adjacent to a ground surface in normal use, and (ii) is comprised of a base material forming a main structure together with a plurality of compact individual first particles made of leather and a plurality of individual second particles made of a second material other than leather, with the compact individual first particles and the individual second particles attached to the base material on the bottom surface of the sole; and (b) an upper portion extending above the sole, wherein the compact individual first particles have a median size within a range of 0.4 to 3.0 millimeters (mm).

2. A shoe according to claim 1, wherein the second material is a plant material.

3. A shoe according to claim 2, wherein said plant material is from a portion of the plant other than a flower, fruit, boll or seed pod of the plant.

4. A shoe according to claim 2, wherein said plant material is only from at least one of a plant's stalks, stems, needles, fronds or husks.

5. A shoe according to claim 4, wherein the second material is comprised substantially entirely of the plant material in its naturally occurring state.

6. A shoe according to claim 1, wherein at least 100 of said compact individual first particles and at least 100 of said individual second particles have been attached to the base material.

7. A shoe according to claim 1, wherein the compact individual first particles have a median size within a range of 0.5 to 2.0 millimeters (mm).

8. A shoe according to claim 1, wherein the compact individual first particles and the individual second particles are attached to the base material using a separate adhesive material.

9. A shoe according to claim 1, wherein the compact individual first particles and the individual second particles have been molded into the base material.

10. A shoe according to claim 1, wherein the compact individual first particles and the individual second particles have been embedded into the base material.

11. A shoe according to claim 1, wherein the compact individual first particles and the individual second particles are attached just to a thin layer of the bottom surface that is not deeper than 10 millimeters (mm).

12. A shoe according to claim 1, wherein the compact individual first particles and the individual second particles are attached just to a portion of the bottom surface that comes into contact with the ground surface during normal use.

13. A shoe according to claim 1, wherein said second material comprises at least one of cornhusk, hemp or straw.

14. A shoe according to claim 1, wherein the compact individual first particles, made of leather, constitute at least 50%, by at least one of weight or volume, of a combination of the compact individual first particles and individual second particles.

15. A shoe according to claim 14, wherein said bottom surface of the shoe has a portion that contacts the ground surface during normal use, and wherein a combination of the compact individual first particles and the individual second particles covers at least 50% of said portion of said bottom surface of the shoe.

16. A shoe according to claim 1, wherein said bottom surface of the shoe has a portion that contacts the ground surface during normal use, and wherein a combination of the compact individual first particles and the individual second particles covers at least 50% of said portion of said bottom surface of the shoe.

* * * * *